US005852905A

United States Patent [19]

Collina et al.

[11] Patent Number: 5,852,905

[45] Date of Patent: Dec. 29, 1998

[54] METHOD FOR MANUFACTURING A COMPOSITE GIRDER AND SO MANUFACTURED GIRDER

[75] Inventors: Vincenzo Collina, Forlì ; Antonio Migliacci, Milan; Gian Luca Guerrini, Milan; Luigi Cassar, Milan, all of Italy

[73] Assignees: Italcementi S.p.A, Bergamo; Gipieffe Architettura Studio Associato, Forli, both of Italy

[21] Appl. No.: 811,974

[22] Filed: Mar. 5, 1997

[30] Foreign Application Priority Data

Mar. 5, 1997 [IT] Italy ..... MI96A0426

[51] Int. Cl.[6] ..... E04C 3/10; E04C 3/26; E04C 3/294

[52] U.S. Cl. ..... 52/223.8; 52/223.9; 52/721.1; 52/729.2; 52/730.6; 52/737.1; 29/897.35

[58] Field of Search ..... 52/223.8, 223.9, 52/721.1, 729.2, 730.6, 737.1; 29/897.35

[56] References Cited

U.S. PATENT DOCUMENTS

| | | | |
|---|---|---|---|
| 4,223,495 | 9/1980 | Peter | 52/223.9 |
| 5,305,572 | 4/1994 | Yee | 52/223.8 |
| 5,471,812 | 12/1995 | Muller | 52/223.8 X |
| 5,560,176 | 10/1996 | Levo | 52/737.1 X |

*Primary Examiner*—Christopher Kent
*Attorney, Agent, or Firm*—Oblon, Spivak, McClelland, Maier & Neustadt, P.C.

[57] ABSTRACT

A method for manufacturing a composite girder including one or more vertical cores of steel plate, associated and cooperating with one or more horizontal slabs or flanges of concrete. At least one of the horizontal slabs or flanges is made from high-performance concrete in order to allow mutual forces or co-actions to be imposed between the several components of the girder which are much higher/stronger than the mutual forces/co-actions which can be imposed by way of other methods and materials. If the composite girder is at least partially manufactured at the prefabrication factory, according to the present method, the starting element will be an I girder preflexed or inflexed with welded connections; the I girder will be positioned on the prefabricating bench imposing such constraints as to straighten the girder, then in a suitable position steel cables are installed prestressed between external anchoring points, and the concrete casting is carried out in a flange in which the cables are associated with high-performance concrete. After setting is complete, the auxiliary constraints are cut and removed. In such a way, the by now set concrete, by being integral with the iron girder thanks to the iron reinforcer elements and welded connections and with the cables by adhesion, causes the several components to mechanically cooperate and the composite beam to be endowed with much better characteristics.

15 Claims, 3 Drawing Sheets

METHOD FOR MANUFACTURING A COMPOSITE GIRDER AND SO MANUFACTURED GIRDER

BACKGROUND OF RE INVENTION

1. Field of the Invention

The present invention relates to a method for manufacturing a composite girder and to the so manufactured girder.

2. Discussion of the Background

Above all, in the field of construction for public works (such as, e.g., bridges, viaducts, roofings for large premises for social activities, and so forth), intense engineering efforts have been done in the past, and are still being done, aiming at manufacturing structures capable of spanning long distances without intermediate supporting structures, with the overall dimensions of the structure being kept small and without sacrifices as regards performance and costs.

A very thin girder has a pleasant appearance and allows either the available room to be better used, or savings to be accomplished in materials used to connect to the girder (if the viaducts of a road/motorway turn-off are thin, the delivery road ramps will be shorter; if railway bridges are thin, they make it possible the whole railway line level to be lowered with the volumes of embankments being reduced). Also, a very thin girder's environment impact will be less striking.

The present state of the art suffers from technical and financial limits.

For example, in order to demonstrate this topic, it will be enough to observe that a girder which must withstand bending stresses, the most suitable commercial materials for withstanding tensile or shear stresses are steel and, above all, steel having a high elastic limit from which cables are made. Unfortunately, while they are of light weight and very strong, both of these materials display an excessively high deformability, which is an unacceptable characteristic when applied loads are highly variable over time.

In that case, they cannot be used to their full capabilities, and also because the fatigue phenomena must be controlled.

Further problems have to be faced also in the case of the by now, classic prestressed concrete girders.

In fact, one should note that the application is prestressing to girders made entirely from concrete presupposes that the concrete portion has undergone a tensional history. Such methods strongly limit the possibility of having girders which are simultaneously light-weight, and thin. Also, such methods require that the concrete not be excessively damaged during the manufacturing and shipping steps.

The above problems, will in any case, stimulate research work focused on developing technical solutions alternative to the, however, generally, valuable technical structural solutions used until now.

Further problems are associated with respect to environmental conditions. In particular, when manufacturing bridges and viaducts in which the structures known from the prior art, owing to their considerably large dimensions and the auxiliary services associated with their construction, have a negative impact on the whole surrounding environment and sometimes cannot be realized, because they do not meet the environmental constraints imposed by the cognizant Authorities.

SUMMARY OF TE INVENTION

In view of the above, a purpose of the present invention is to provide a girder structure which combines the favorable features of the solutions known from the prior art, and eliminating, as far as possible, the technical problems and drawbacks associated with them and which, of course, have derived from them until now.

A further purpose of the invention is to provide a girder structure which overcomes all of the limitations of use and strength which affected the girders used in the structures known from the prior art.

Another purpose is to provide a structure which is able to meet the environmental constraints and which, while invading the territory, alters and damages the surrounding environment to the smallest extent possible.

These purposes according to the present invention are achieved by providing a method according to the appended claims.

Also, advantageously, a composite girder is provided in which the bottom slab of the girder is made from high-performance concrete.

According to the present invention, by cooperatively associating the high-performance concrete slab or flange, which performs the function of a bonding agent which binds the cables and the steel girder and submitting said slab or flange to a suitable co-action during the manufacturing process, the purpose is achieved of stiffening the girder in such a way as to have, simultaneously, the necessary stiffness to beading and the maximal use of steel which, obviously, is no longer subject to the fatigue phenomena.

Actually, using steel for manufacturing a portion of the girder, besides making possible a lighter weight structure to be obtained, introduces, in the laws which control girder design, the possibility of varying the material additionally to the possibility of varying the geometry. The above benefits are advantageously enhanced by the use of high-performance concrete, where the compression strength characteristics of which are more similar to steel than to conventional concrete.

BRIEF DESCRIPTION OF THE DRAWINGS

The characteristics and advantages of a composite girder and of the method of manufacturing it according to the present invention will be more evident from the following, exemplifying, non-limitative disclosure, when considered in connection with the accompanying schematic drawings in which.

DESCRIPTION OF THE PREFERRED EMBODIMENTS

Figure 1:
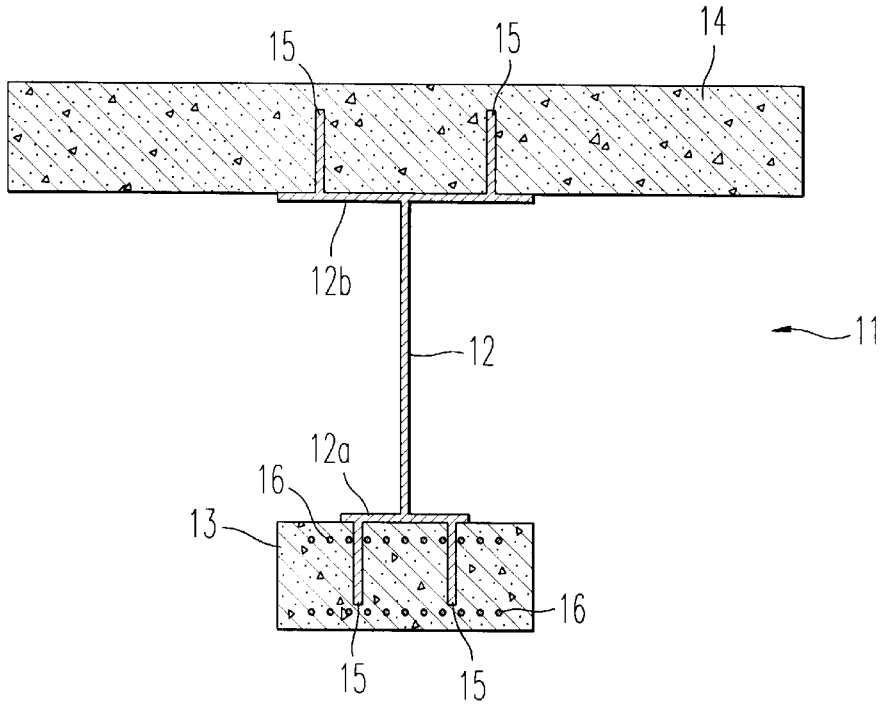
FIG. 1 shows a cross sectional view of a composite girder manufactured according to the present invention.

Referring to FIG. 1, a composite girder manufactured according to the present invention, generally indicated with (11), has a "T"-shaped cross-section and includes an "I"-shaped steel girder (12) the core of which is vertically arranged.

Associated with the steel girder (12) are two flanges or slabs (13) and (14), i.e., the lower (or bottom) flange or slab (13), and the upper (or top) flange or slab (14), fastened by means of steel connecting means (15). The slabs (13) and (14) are made from concrete, and the bottom slab (13) is made from high-performance concrete. High-performance concrete is characterized by a high compression strength associated with a high elastic modulus, which is constant over time.

In particular, under "high-performance concrete", a high- or very high-strength concrete is understood, which displays a compression strength within the range of 70 MPa to 200 MPa, preferably of 100 MPa, and an elastic modulus within the range of 30 GPa to 60 GPa, preferably of 40 GPa.

In order to obtain such concrete grades, cements can be used which at least meet the requirements of class 42.5 according to European Standard ENW 197.1, and include selected aggregates with high physical-mechanical characteristics, for example granite, limestone, quartz and/or basalt, and high dispersing superfluidizers, in order to obtain water/cement ratios of less than 0.45, preferably of less than 0.30, still more preferably of less than 0.25.

The use is furthermore possible of fumed silicas with an average particle size of approximately 0.2 micron and a specific surface area of approximately 18 $m^2/g$. Then, also, the use of metal and/or polymeric fibers can be advantageous in order to obtain high-performance concretes displaying characteristics of high ductility and resistance to the applied combination of compressive and bending stresses. Use of high-performance concrete improves the durability of the material.

Inside the interior of the bottom slab (13) are installed a plurality, or bundle, of prestressing cables (16), e.g., arranged as two mutually superimposed rows, laid under a base platband (12*a*). These cables (16) realize the co-action of axial-eccentric type—then the external prestressing constraints are removed—because they adhere to the surrounding concrete. According to an alternative embodiment, the cables can be housed inside cable ducts and can then be prestressed after the concrete has aged.

The bottom slab (13) is usually manufactured at the prefabrication factory, while the top slab (14) can be, alternatively, manufactured in place, besides being manufactured in the prefabrication factory, according to requirements.

A girder constituted by these materials shall withstand bending stresses applied on its middle vertical plane, which would tend to stretch the bottom fibers.

Figure 2:
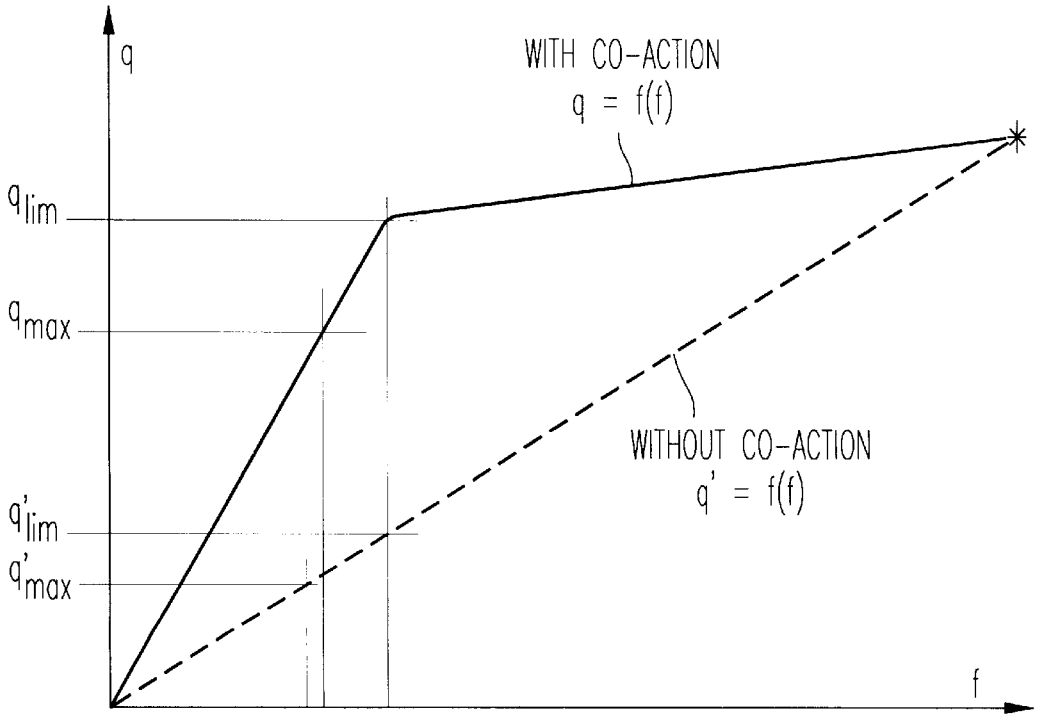
FIG. 2 is a chart illustrating the behavior of a girder of the prior art not submitted to co-action (shown in chain line) and of a composite girder submitted to co-action according to the present invention (solid line)
Figure 3:
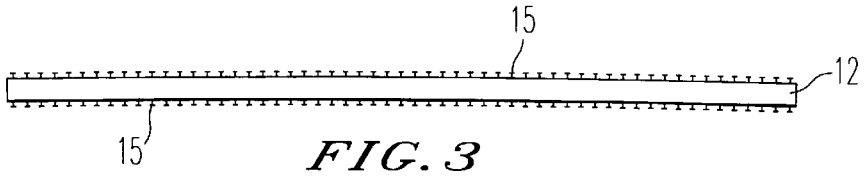
FIG. 3 shows a longitudinal elevation view of a steel girder preflexed or inflexed and fitted with connecting means during a first step of the method according to the present invention.
Figure 4:
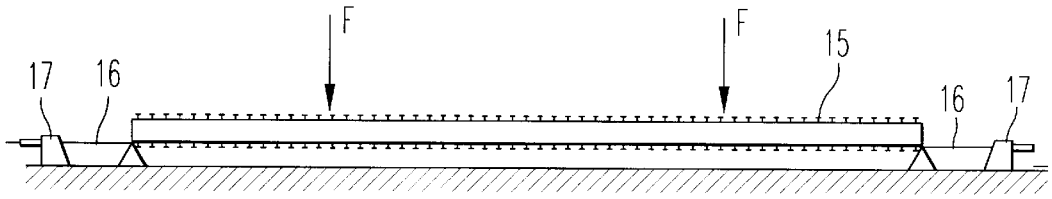
FIG. 4 shows a longitudinal elevation view of the girder of FIG. 3, when forces are imposed on it by means of auxiliary constraints and with positioned cables prestressed by means of external constraints, and in FIG. 4*a* a chart displays the torques impressed on the girder.
Figure 4A:
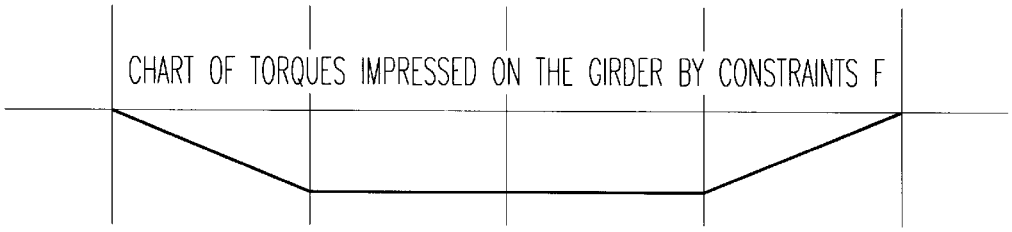

The specific characteristic of the materials used, on the other hand, would not allow the girder to operate correctly when submitted to the operating loads, if the materials were not installed while simultaneously submitting them to co-action according to the present invention. However, the materials are installed under the influence of co-action so as to obtain the high initial mechanical characteristics (under low stress levels) that are retained also at the stress levels originated by the operating loads, as is shown in the chart of FIG. 2. In this chart, the behavior is depicted of a girder known from the prior art not submitted to co-action (indicated in chain line) and of a girder submitted to co-action according to the present invention (shown in solid line).

As mentioned hereinabove, the co-actions can be induced partially at the manufacturing factory and partially in place at the time of installation.

The practical availability of high-performance concrete makes it possible that two types of co-action be combined, i.e.:

1. The co-action of flexural type, obtained by inflexing the steel girder (12) so as to prestress the bottom fibers and "freezing" this prestressed state by applying the bottom slab (13) made from high-performance concrete. The high value of the elastic modulus of the latter, and the constance of this value over time, enables the so obtained co-action state to be retained at a high level and without any significant effects due to the phenomena of creep.
2. The co-action of axial type, obtained by prestressing the steel cables (16) before manufacturing the slab (13), so that, when the prestressing constraints are removed, the whole girder results to be in a state characterized by the presence of a combination of compressive and bending stresses, i.e., inversely loaded relative to the stresses generated by the loads reacted during use. The characteristic of high compression strength displayed by the high-performance concrete is the feature which allows the bending or flexural co-action to be combined with the axial co-action, resulting in a large increase in ultimate strength performance being consequently obtained without increasing the amount of steel used in the girder (12). Then, as the value and the distribution of the bending co-action can be regulated relative to the axial co-action, under operating conditions one can obtain the result that the state of compression of the slab (13) is nearly constant throughout the length of the girder. As a consequence, the prestressing cables (16) can be kept adhering throughout the length of the girder, with the benefit of product compactness and durability. The presence of the steel girder (12) being electrically connected with the cables (16) causes said cables (16) to be protected from the phenomena of galvanic corrosion. The state of tensile stress impressed on an upper platband or flange (12*b*) made from steel allows the girder to be installed for casting the upper concrete slab (14) without either tension or elastic stability problems.

A composite girder according to the present invention is manufactured according to a method which can be schematically disclosed as follows. In fact, the necessary sequence of steps for impressing the co-actions and consequently producing the composite girder can be isolated and represented as displayed in FIGS. 3–9. The relevant stress charts are associated with some of the figures.

In a first step of the method, a steel girder (12) is selected and to its platbands **(12*a*) and (12*b*) are fastened a plurality of connecting means (15)** made from steel. Furthermore, the girder is constructed in a preflexed or inflexed configuration.

In a second step, the bundle of cables are installed as one or two series of adhering cables (16) which are prestressed and blocked by means of auxiliary external constraints (17), with forces (F) being applied by means of auxiliary constraints on the workbench. Said arrangement shown in FIG. 4, which also displays the chart of the torques impressed on the steel girder by the forces (F) and the presence of the constraints (17).

Figure 5:
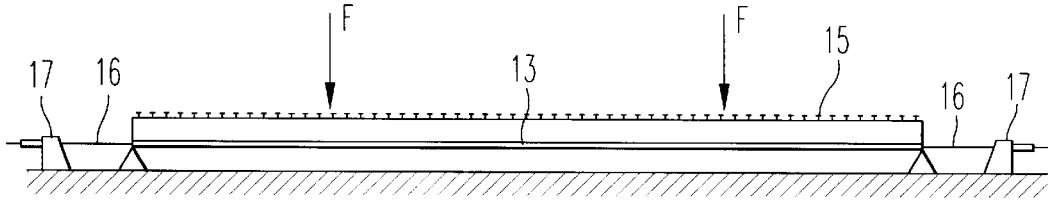
FIG. 5 shows the longitudinal elevation view of the girder of FIG. 4 on which the bottom concrete flange has been realized.

When such a condition is reached, the bottom slab or flange (13) is manufactured by suitably casting the high-performance concrete from which it is made, and causing said concrete to set. The concrete is cast so as to catch the purposely provided connecting means (15) (FIG. 5).

Figure 6:
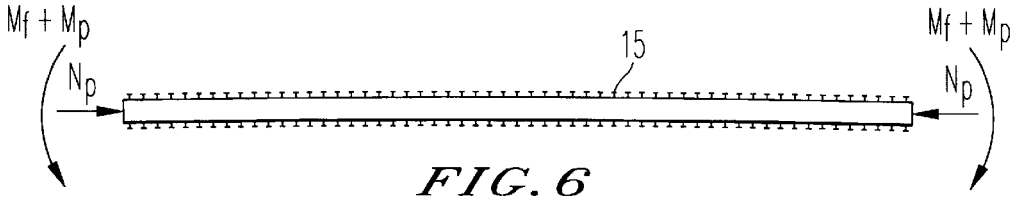
FIG. 6 illustrates the girder of FIG. 5 from which the external constraints of cables prestressing the girder and the forces created by the auxiliary constraints have been removed, and in FIG. 6*a* a chart displays the tensions imposed on the lower edge of such a girder.
Figure 6A:
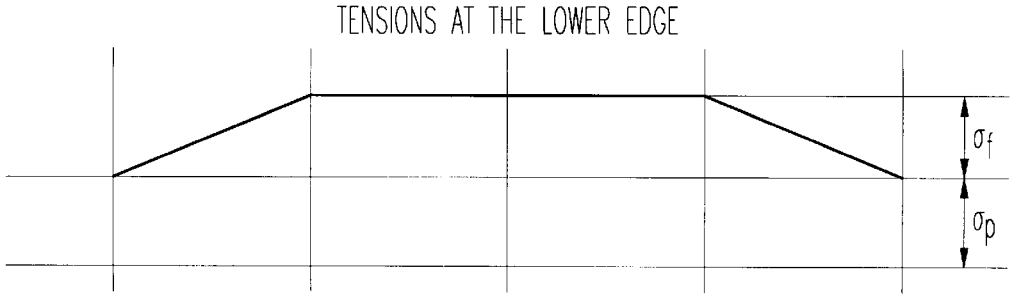

After that, the constraints acting on the cables (16) (which get released), the auxiliary constraints (17) and the forces (F) are all removed, as shown in FIG. 6. The partially realized girder (11) is now submitted to tensile stresses, as displayed in the scheme **(6*a*) associated with FIG. 6**.

Now demonstrated is the basic importance of using high-performance concrete, which is able to withstand the stresses induced by the bending coaction simultaneously with the stresses induced by the prestressing and, in such a way, allows the process to be implemented. These sequence of steps being carried out at the prestressing factory.

Contrary to the above, the next steps can be performed either at the prefabrication factory, or directly in place, as briefly mentioned hereinabove. In fact, the upper concrete slab or flange must be manufactured.

For the sake of better understanding, in the following, the construction is hypothesized for exemplifying, non-limitative, purposes, of a viaduct with an upper slab made from concrete (which may be either a normal, or a high-performance concrete) realized in place, and cooperating.

Figure 7:
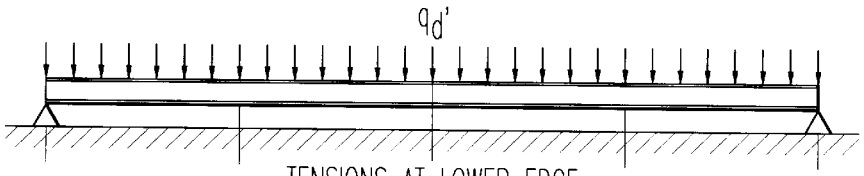
FIG. 7is a further illustration of the girder of FIG. 6, to which the upper concrete flange is applied, and FIG. 7*a* the chart displays the tensions existing at the lower edge of said girder.
Figure 7A:
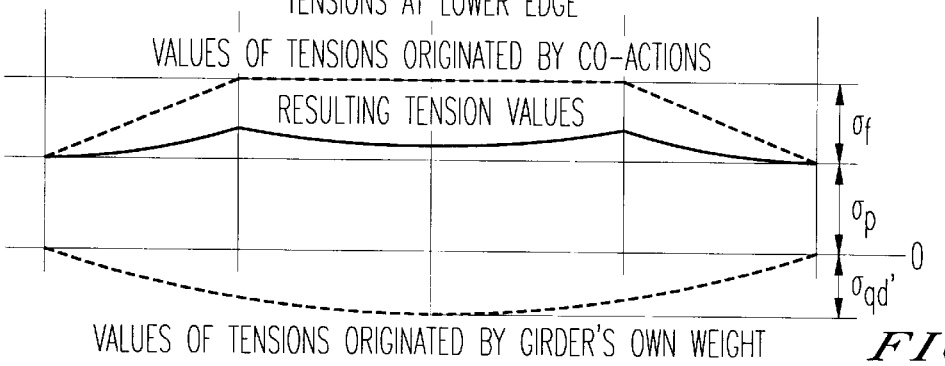

Then, the girder manufactured at the prefabrication factory is installed in its end position, and a further step of concrete casting is carried out with application of its own weight and of the weight of the slab, both schematically shown as $q_d$(FIG. 7). The chart of the tensile stresses is consequently changed, as shown in FIG. **7*a***.

Figure 8:
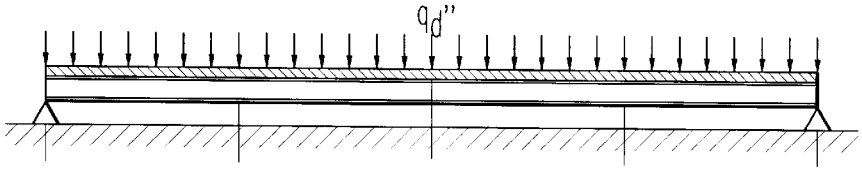
FIG. 8 illustrates a further step in which the concrete of the upper flange has set and the construction of the upperworks takes place, and in FIG. 8*a* the chart shows the tensions existing at the lower edge of said girder.
Figure 8A:
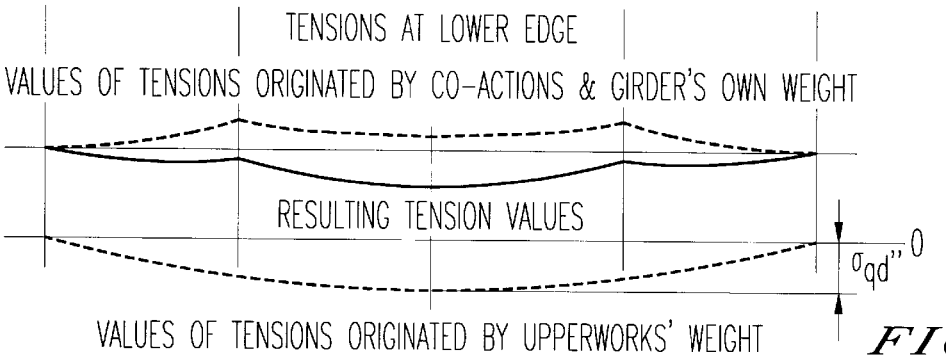

When the above described step is complete, concrete (14) is allowed to set and then the upperworks are manufactured, with the relative weight $q_{d'}$ being applied (FIG. 8). The chart consequently changes, as illustrated in FIG. **8*a***.

Figure 9:
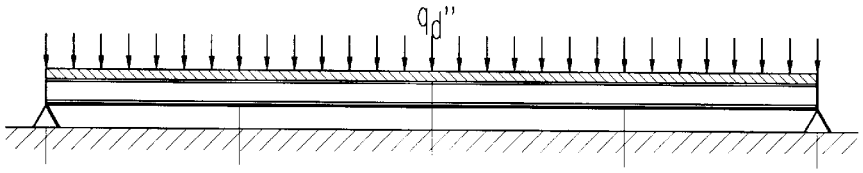
FIG. 9 displays the application of moving loads on the finished girder according to the present invention, and in FIG. 9*a* the chart shows the tensions existing at the lower edge of said girder.
Figure 9A:
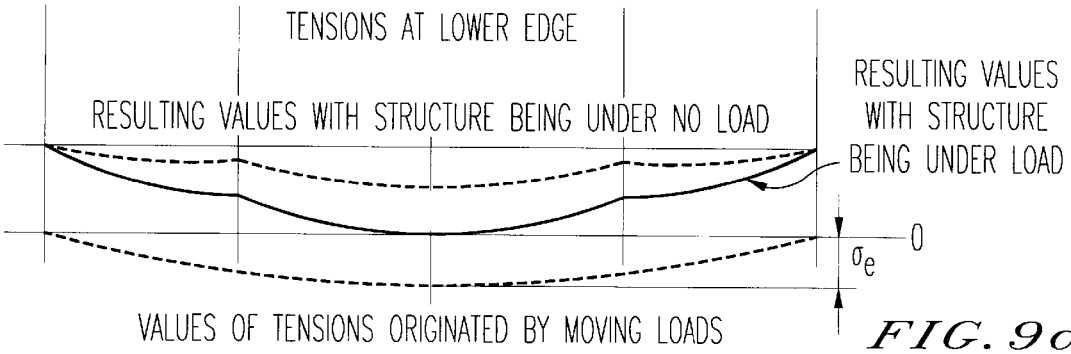

By means of the application of mobile loads, indicated with $q_e$, the end behavior of the girder according to the present invention is recorded. FIGS. 9 and **9*a*** show the mobile load and its effect.

As already said several times hereinabove, the end composition of the girder of the present invention can be reached, as well, at the prefabrication factory, by means of reproduction of the application points.

One will observe that the tensile stresses undergone by the (high-performance) concrete of the slab (13) reach high levels during the initial construction steps, during which they perform the function of blocking the deformability of the steel cables (16) and of the steel girder (12), and then the stresses decrease to extremely low values during use, with small changes deriving from the application of moving loads.

This feature secures that the initial qualities will be retained over time.

Also the stresses deriving from the mutual connection of slab (13) and girder (12) decrease considerably when the girder is finished.

This feature is a consequence of the matter of fact that the chart of tensions impressed on the slab (13) is very similar to the tensions arising from the loads (chain line).

A composite girder as realized, according to the method of the present invention, displays advantageous characteristics of light weight, low cost, durability associated with high-performance of strength, stiffness and thinness, thus resulting, as already said, to be particularly suitable for building railway and road viaducts due to its limited dimensions in height as compared to the girders known from the prior art, as mentioned and discussed hereinabove.

The effectiveness and functionality of the girders according to the present invention are furthermore due to the use of high-performance concrete which is characterized by a high compression strength associated with a high value of elastic modulus, which does not vary much with time. In fact, this type of concrete performs the task of stiffening the girder, thus reducing its bending deformability due to the application of moving loads.

All of the features discussed above cause a large improvement in the limit state of use, while reducing the fatigue phenomenon the girder is submitted to.

A further feature is the use of the steel strand in the bottom slab or flange according to the steps of the method according to the present invention. The installation of the steel cables or strands is beneficial due to the use and presence of high-performance concrete which is able to be prestressed not only by the bending co-action developed by the steel girder which constitutes the core of the structure, but, above all, by the prestressing of the rather large number of strands installed inside it.

It should be furthermore observed that the steel girder of the central core is cheap, while having good characteristics. The same is true for the cables which are very cheap with the developed strength being the same.

Furthermore, according to the present invention, we wish to emphasize that the advantageous structure of the girder of the invention is accomplished due to the prestressing of the cables and to their being blocked against the concrete either by adhesion, or by means of anchoring heads, to the consolidation of said concrete and to the subsequent release of the external auxiliary constraints. The cables are prevented from getting loose by the stiffness of the steel girder coupled with the intrados flange or slab.

The possibility of partially manufacturing at the prefabrication factory facilitates the shipping thereof to the installation place and the installation thereof.

We claim:

1. A composite girder comprising:

at least one steel girder having a vertical core, said at least one steel girder being preflexed or inflexed;

at least one slab of concrete associated with a longitudinal direction of said steel girder;

steel connecting elements connecting said at least one slab of concrete to said at least one steel girder;

at least one series of cables adhering to said at least one slab of concrete; and a platband of said at least one steel girder adhering to said at least one slab of concrete, wherein one of said at least one slab of concrete is made from high-performance concrete, and said at least one series of cables is embedded within said one of said at least one slab of concrete.

2. Composite concrete girder according to claim 1, further comprising a second concrete slab of said at least one slab of concrete connected to said girder.

3. Composite concrete girder according to claim 1, wherein said high-performance concrete has a compression strength within a range of 70 Mpa to 200 Mpa, and an elastic modulus within a range of 30 GPa to 60 GPa.

4. Composite concrete girder according to claim 1, wherein said high-performance concrete uses superfluidizers with a high dispersing effect in order to obtain water/cement ratios lower than 0.45.

5. Composite concrete girder according to claim 1, wherein said high-performance concrete uses fumed silicas having an average particle size of substantially 0.2 micron and a specific surface area of at least 18 $m^2/g$.

6. Method for manufacturing a composite girder including a steel girder with at least one vertical core of steel and at least one slab of concrete is associated with a longitudinal arrangement of the steel girder, and steel connecting elements provided in the concrete, the method comprising the steps of:

a first step of positioning the steel girder in a preflexed or inflexed state;

a second step of arranging at least one series of cables adhering to a platband of the steel girder;

a third step of prestressing at least one series of cables simultaneously with forces and auxiliary constraints being applied on the steel girder;

a fourth step of forming a high-performance concrete slab embedding said at least one series of cables; and a fifth step of removing said prestressing of said cables due to the forces and the auxiliary constraints.

7. Method according to claim 6, further comprising a second slab of said at least one slab of concrete.

8. Method according to claim 6 or 7, wherein said high-performance concrete slab is a bottom slab.

9. Method according to claim 6, wherein said method steps are performed at the manufacturing factory.

10. Method according to claim 6, wherein said high-performance concrete has a compression strength within a range of 70 MPa to 200 MPa, and an elastic modulus within a range of 30 GPa to 60 GPa.

11. Method according to claim 5, wherein said high-performance concrete uses superfluidizers with a high dispersing effect in order to obtain water/cement ratios lower than 0.45.

12. Method according to claim 5, wherein said high-performance concrete uses fumed silicas having an average particle size of substantially 0.2 micron and a specific surface area of at least 18 $m^2/g$.

13. Method according to claim 7, wherein said second slab is manufactured in place.

14. Method according to claim 6, wherein said forces are forces suitable for applying a combined compressive and bending stress on said steel girder.

15. Method according to claim 6, wherein said steel girder is electrically connected with said series of cables.

* * * * *

UNITED STATES PATENT AND TRADEMARK OFFICE

CERTIFICATE OF CORRECTION

PATENT NO. : 5,852,905

DATED : December 29, 1998

INVENTOR(S) : Vincenzo COLLINA et al.

It is certified that error appears in the above-identified patent and that said Letters Patent is hereby corrected as shown below:

On the title page, item [30], Foreign Application Priority Data information should read:

--[30] Mar. 5, 1996 [IT] Italy .....MI96A0426--

Signed and Sealed this

Twenty-fifth Day of May, 1999

*Attest:*

Q. TODD DICKINSON

*Attesting Officer*

*Acting Commissioner of Patents and Trademarks*